US008366292B2

(12) United States Patent
McDermott

(10) Patent No.: US 8,366,292 B2
(45) Date of Patent: Feb. 5, 2013

(54) PLURAL COLOR LIGHTING DEVICE

(76) Inventor: Damien McDermott, Rockledge, FL (US)

( * ) Notice: Subject to any disclaimer, the term of this patent is extended or adjusted under 35 U.S.C. 154(b) by 207 days.

(21) Appl. No.: 12/454,056

(22) Filed: May 12, 2009

(65) Prior Publication Data

US 2010/0290220 A1 Nov. 18, 2010

(51) Int. Cl.
*F21V 9/00* (2006.01)

(52) U.S. Cl. ... 362/231; 362/170; 362/238; 362/249.05; 362/249.07

(58) Field of Classification Search ..... 362/170, 362/197, 231, 238, 249.05, 249.07, 233
See application file for complete search history.

(56) References Cited

U.S. PATENT DOCUMENTS 7,168,828 B2 * 1/2007 Schmidt et al. ..... 362/471
7,621,653 B2 * 11/2009 Hendrie ..... 362/231
7,988,318 B1 * 8/2011 Smith et al. ..... 362/187

* cited by examiner

*Primary Examiner* — John A Ward
(74) *Attorney, Agent, or Firm* — Kevin T. Price

(57) ABSTRACT

A plural color lighting device incorporating a plurality of LED emitters each emitting a different color of light upon being energized by a power supply. A color changer having an indexing position for each LED emitter for activating a related switch and connecting the power supply to the LED emitter while concurrently positioning a light concentrating optic about the LED emitter to concentrate the light emitted from that LED emitter. The plural color lighting device therefore permitting the user to easily select light of any one color from a plurality of colors and have that light efficiently concentrated about the axis of the light concentrating optic.

38 Claims, 4 Drawing Sheets

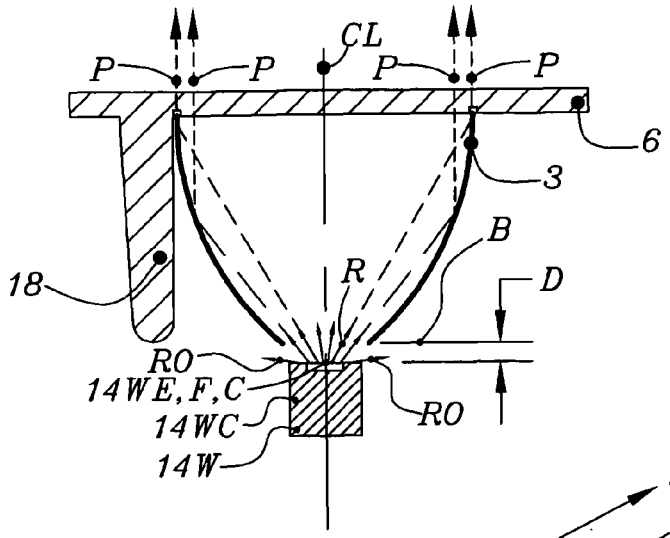
FIG 7
FIG 8
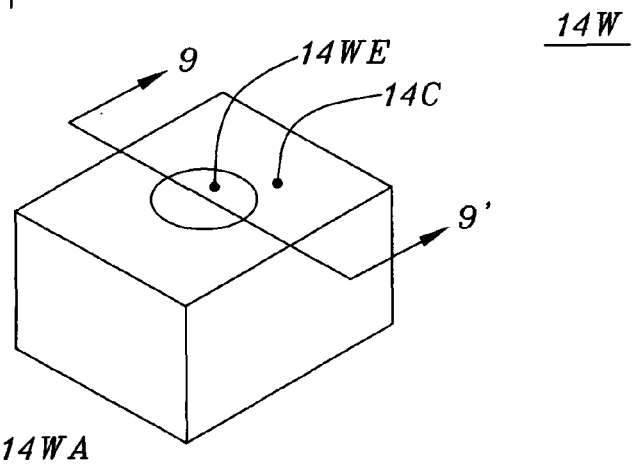
FIG 9
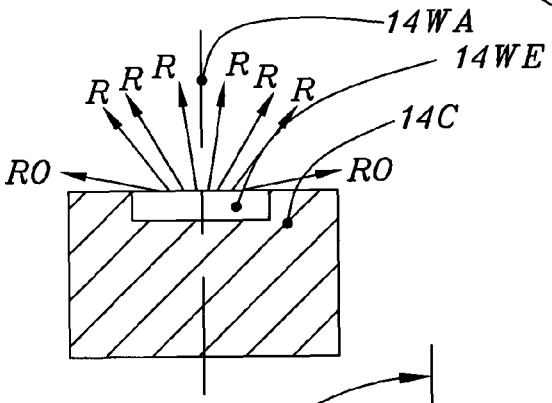
FIG 10
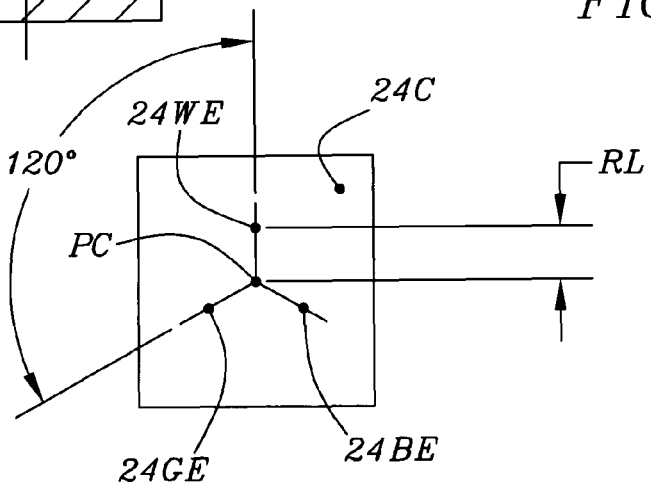

PLURAL COLOR LIGHTING DEVICE

BACKGROUND OF THE INVENTION

1. Field of Invention

Lighting devices such as flashlights are frequently required to emit light of more than one color. These plural color lighting devices permit their operator to select any of several colors of emitted light.

Plural color lighting devices are required to be efficient in both creating light and concentrating the light into a desired beam pattern. LED emitters are highly efficient sources of light, available in a multiplicity of colors and typically emit their light in a hemispherical pattern. Light concentrating optics are used to condense the hemispherical light from LED emitters into a concentrated light beam. Light concentrating optics such as parabolic reflectors are well known devices employed to concentrate light into a concentrated beam.

2. Prior Art

Plural color lighting devices have in prior art included an incandescent lamp with its color altered by covering it with any one of a plurality of color filters.

LED light emitters have been employed with large parabolic reflectors to create flashlights with high intensity concentrated light beams. In order to maximize the efficiency of the device and collect all of the light emitted by the LED emitter the large parabolic reflector is made to fill the entire hemisphere above the LED emitter. In these designs, the LED emitters are small and usually positioned within a large parabolic reflector at the focal point. The large size of the parabolic reflector relative to the LED emitter is desirable because this assures efficient control of the light being concentrated.

These prior art designs emit a concentrated light beam of only one color with that color determined by the color emitted by the LED emitter. An efficient prior art design could be created to emit a plurality of colors, however, this would require a plurality of large parabolic reflectors each with a dedicated LED emitter of a different color at its focal point. The plurality of large parabolic reflectors would make the design bulky and expensive both of which are undesirable. Bulky lighting devices are more easily damaged, difficult to hold and more costly to store and ship.

- Prior art has not produced a plural color lighting device which is compact and highly efficient.
- Prior art has not produced a plural color lighting device which uses a single parabolic reflector to concentrate light of different colors emitted by a plurality of LED emitters.
- Prior art positions the LED emitter very close to the reflector to maximize efficiency leaving no clearance for unencumbered relative lateral movement.
- Prior art does not move the reflector relative to the LED.
- Prior art does not concentrate a plurality of visually identifiable discrete colors using a single reflector.
- Prior art does not provide a switching system to energize the LED when the LED is at the focal or light concentrating point of the reflector or a switching system to extinguish the LED when it is away from the focal point.
- Prior art does not provide a color changer mechanism to move a single reflector relative to a plurality of LED emitters

OBJECTS AND ADVANTAGES

The objects and advantages of the present invention are:

- to provide a lighting device which employs a moveable color changer which can be used to select any one of a plurality of emitted colors or to select an "OFF" mode or indexing position
- to provide an efficient lighting device which is compact, can emit a plurality of colors and is less expensive to manufacture than prior art
- to provide an efficient lighting device which can emit a plurality of colors, is easier to hold and easier to direct than prior art
- to provide a lighting device which employees a single light concentrating optic or reflector to efficiently concentrate the light from any one of a plurality of LED emitters each of a different color
- to provide a high efficiency lighting device which permits the user to move a component such as a color changer to an indexing position and thereby activate a switch to energize a LED emitter of a first color while simultaneously moving a reflector to a light concentrating position about the LED emitter so that its emitted light is efficiently concentrated into a light beam. The user can additionally move the color changer to a second indexing position and thereby activate a second switch to energize a second LED emitter of a second color while simultaneously moving the reflector to a light concentrating position about the second LED emitter so that its emitted light is concentrated into a light beam.
- to provide a lighting device which includes a switching means for each of a plurality of LED emitters of distinct colors to energize each LED emitter as it is positioned at a light concentrating point relative of a light concentrating optic and to extinguish the LED emitter as it is moved from the light concentrating point
- to provide a lighting device having a light concentrating reflector at a predetermined clearance distance from each of a plurality of LED emitters permitting relative lateral unencumbered movement to selectively position each LED emitter at a light concentrating point of the reflector.

SUMMARY

A plural color lighting device comprising a plurality of LED emitters on a housing. Each LED emitter having a different color. The housing moveably connected to a color changer comprising a light concentrating optic. The light concentrating optic having a light concentrating point and by means of the color changer a moveable relationship with the LED emitters such that each of the LED emitters can be positioned at the light concentrating point of the optic. The color changer moveably positions the optic so that each LED emitter can be disposed at a light concentrating point usually at the focal point of the optic to have its emitted light concentrated. The optic usually of a parabolic reflector design concentrates the light emitted by the LED emitter located at its focal point towards parallelism with the axis of the reflector forming an intense light beam approximately parallel with the axis of the reflector. The moveable relationship between the reflector and the LED emitter comprises a rotational movement of the reflector about a center of rotation of the color changer. The focal point of the reflector is at an LED radius distance from the center of rotation of the color changer. Each LED emitter is also positioned at the LED radius distance from the center of rotation of the color changer. The lighting device comprises an optional indexing system comprising an indexing position for each LED emitter to facilitate the rotational alignment of the reflector with a selected LED emitter. The lighting device further includes a switching system that comprises a switch for each LED emitter. Each switch energizes its related LED emitter with a power supply when the LED emitter is at the focal point of the reflector and de-energizes it when it is away from the focal point. The switch for the LED emitter is activated by a switch activator attached to the color changer. The switch activator is moved to a switch activation position for the LED emitter as the color changer is moved to the indexing position of the color changer related to the selected LED emitter.

In use a person can move the color changer to select an indicator for any one of a plurality of distinct colors to energize the LED emitter related to emit the selected color and to place that emitter at the focal point of a reflector where the emitted light is concentrated towards parallelism and projected from the lighting device.

DRAWINGS

FIG. 1 is a perspective view of lighting device 25 of the present invention FIG. 2 is FIG. 1 with the color changer 1 removed FIG. 3 is a partial cross-section taken across 3-3' of FIG. 1 and rotated FIG. 4 is a top view of circuit 13 removed from FIG. 2

FIG. 7 is a diagrammatic view of cover 6, reflector 3 and white LED 14W removed from FIG. 3

FIG. 8 is an enlarged perspective view of white LED 14W removed from FIG. 4

FIG. 9 is a cross-section of white LED 14W taken across line 9-9' of FIG. 8

FIG. 10 is a top view of plural color LED 24

DRAWINGS—REFERENCE LETTERS

Figure 1:
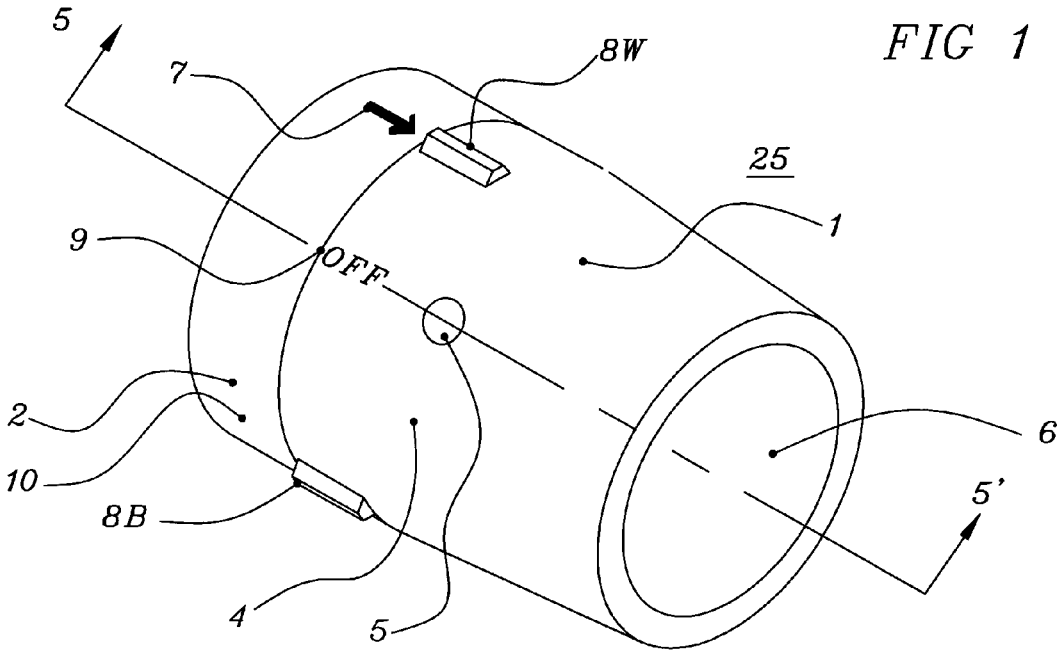

B Reflector Base Line
C Light Concentrating Point
CA Switch Activator Centerline
CAL Switch Activator Locus
CE Element Centerline
CH Housing Centerline
CL Reflector Centerline
CLL Reflector Centerline Locus
CR Color Changer Centerline
D Clearance Distance
F Focal Point
LC LED Circle
P Projected Light
PC Plural LED Center
R Forward Light Rays
RL LED Radius
RO Oblique Light Rays
RS Switch Radius
SC Switch Circle

DRAWINGS—REFERENCE NUMERALS

1 color changer
2 housing
3 parabolic reflector
4 shell
5 pin
6 cover
7 arrow
8B blue indicator
8G green Indictor
8W white indicator
9 "OFF" indicator
10 hub
11 body
12 groove
13 circuit
14
14B blue LED
14BC blue LED base
14BE blue LED element
14G green LED
14GC green LED base
14GE green LED element
14W white LED
14WA white LED axis
14WC white LED base
14WE white LED element
15
15B blue switch
15G green switch
15W white switch
16 power supply
17 printed circuit board
18 switch activator
19
20
21
22
23
24 plural color LED
24BE plural blue element
24C plural LED base
24GE plural green element
24WE plural white element
25 lighting device Operational Description Of The Preferred Embodiment FIGS. 1-10

Figure 2:
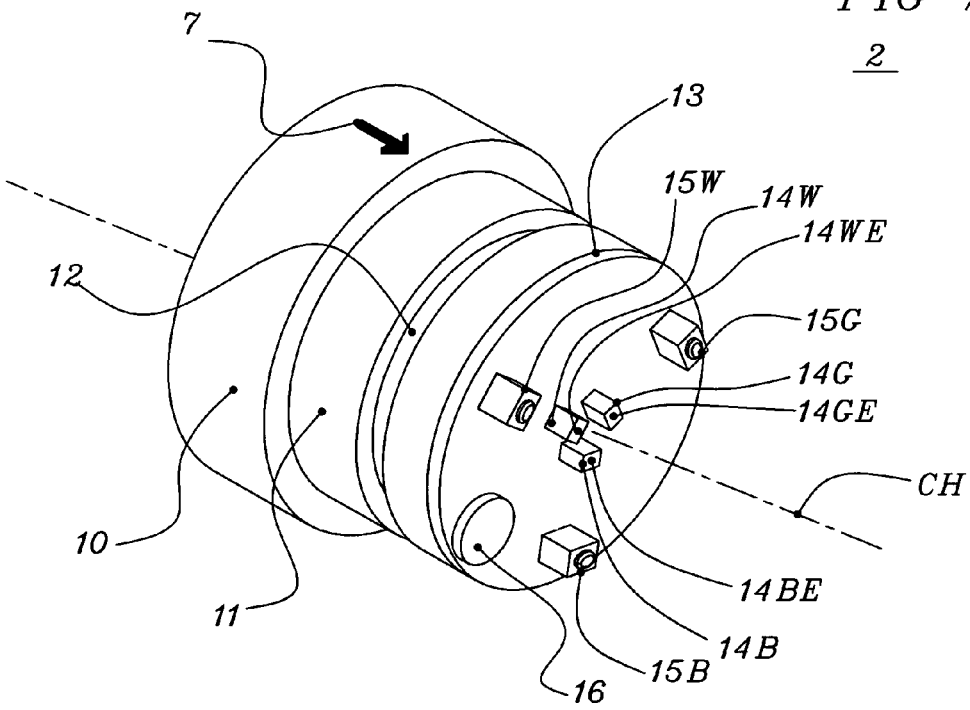
Figure 3:
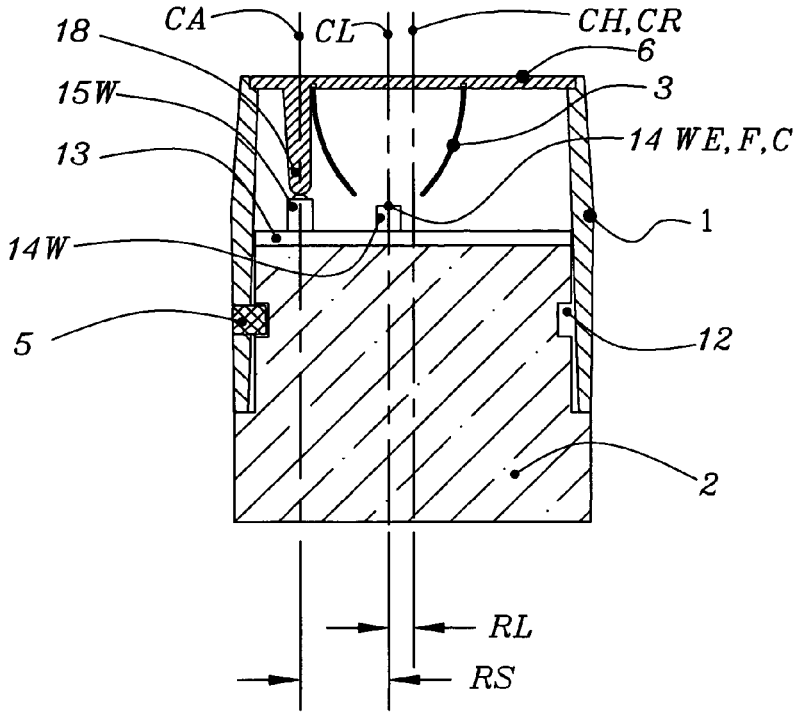

In the drawings, closely related components have the same number but different alphabetic suffixes. A preferred embodiment of the plural color lighting device of the present invention is illustrated in FIGS. 1 through 9. FIG. 1 is a perspective view of lighting device 25. FIG. 2 is lighting device 25 of FIG. 1 with color changer 1 removed. FIG. 3 is a partial cross-section across line 3-3' of FIG. 1, however FIG. 3 is rotated so that cover 6 is on the top. In FIGS. 1, 2 and 3 plural color lighting device 25 consists of color changer 1 and housing 2. Color changer 1 comprises a light concentrating optic in the form of parabolic reflector 3 within shell 4 both usually molded of a high impact resin. Parabolic reflector 3 is cup shaped and usually defined by rotating a parabolic contour about reflector centerline CL. Parabolic reflector 3 is normally designed to maximize the percentage of light emitted by the light source positioned at its focal point F and subsequently reflected. Housing 2 includes hub 10, body 11, groove 12 and arrow 7 all molded as one piece. Shell 4 is placed over body 11 and comprises pin 5 pressed into a hole in shell 4 and entering groove 12 of body 11. Pin 5 is shown pressed into a hole in shell 4 however it can alternatively have a thread permitting it to be removeable from a threaded hole in shell 4. Shell 4 further includes white indicator 8W usually painted white, green indicator 8G—to be shown in FIG.

6—usually painted green and blue indicator 8B usually painted blue all of which are ribs molded as part of shell 4 and equally spaced at 120 degrees about color changer centerline CR. Shell 4 also comprises "OFF" indicator 9.

Color changer 1 is moveably attached to housing 2 and comprises a plurality of indexing positions relative to housing 2. By having pin 5 in groove 12 during assembly color changer 1 is attached to—yet can be rotated about—housing 2 without separating from housing 2. Housing 2 includes arrow 7 a housing indicator which can be positioned to point to either white indicator 8W, green indicator 8G, blue indicator 8B or "OFF" indicator 9 as color changer 1 is rotated. For reasons to be later described plural color lighting device 25 will emit a concentrated white light when indictor arrow 7 is pointed towards white indicator 8W, a concentrated green light when pointed towards green indicator 8G and a concentrated blue light when indicator arrow 7 is pointed towards blue indicator 8B. Thus color changer 1 and housing 2 each have indicators for locating each of the plurality of indexing positions.

Housing 2 also includes circuit 13 attached to the end of body 11 with an adhesive or other common fastening means.

Figure 4:
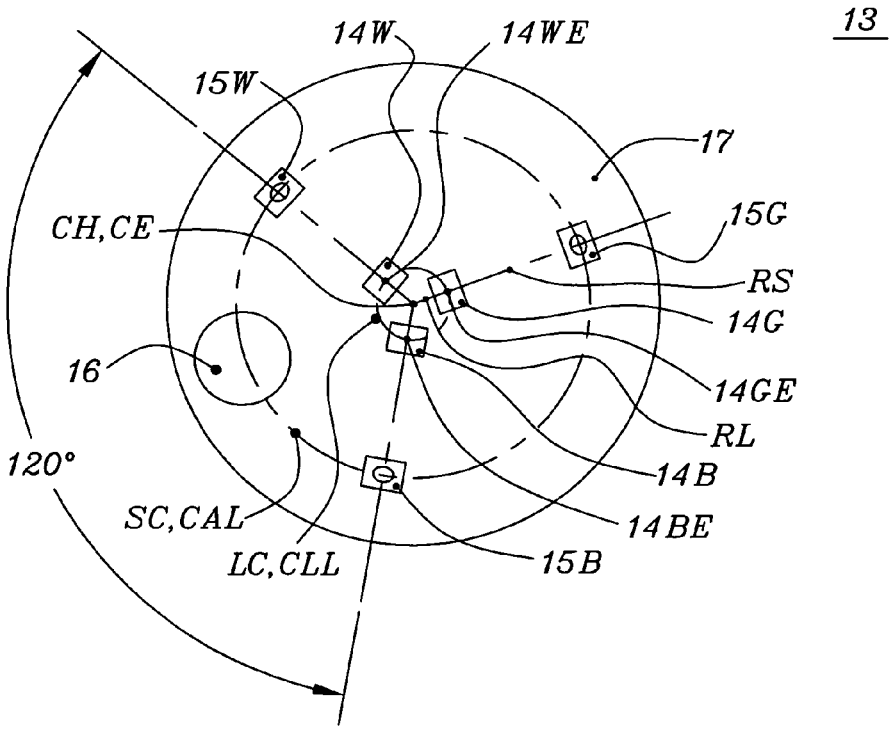

FIG. 4 shows a top view of circuit 13 removed from FIG. 2. Circuit 13 comprises three LED lamps or light sources each upon being connected to a power supply emitting a distinct colored light. These include white LED 14W having white switch 15W, green LED 14G having green switch 15G, blue LED 14B having blue switch 15B and power supply 16 all attached to or mounted on PC board 17. Power supply 16 is for the present embodiment a button type battery having a voltage of approximately 3V which is the voltage required to energize any of the three LED light sources shown. LEDs emitting colors distinct from those identified in the present embodiment can be employed in this invention, however they may require the power supply to have a different voltage or require the addition of one or more resistors to circuit 13 configured according to standard design practices to meet the specification of each LED light source.

Figure 5:
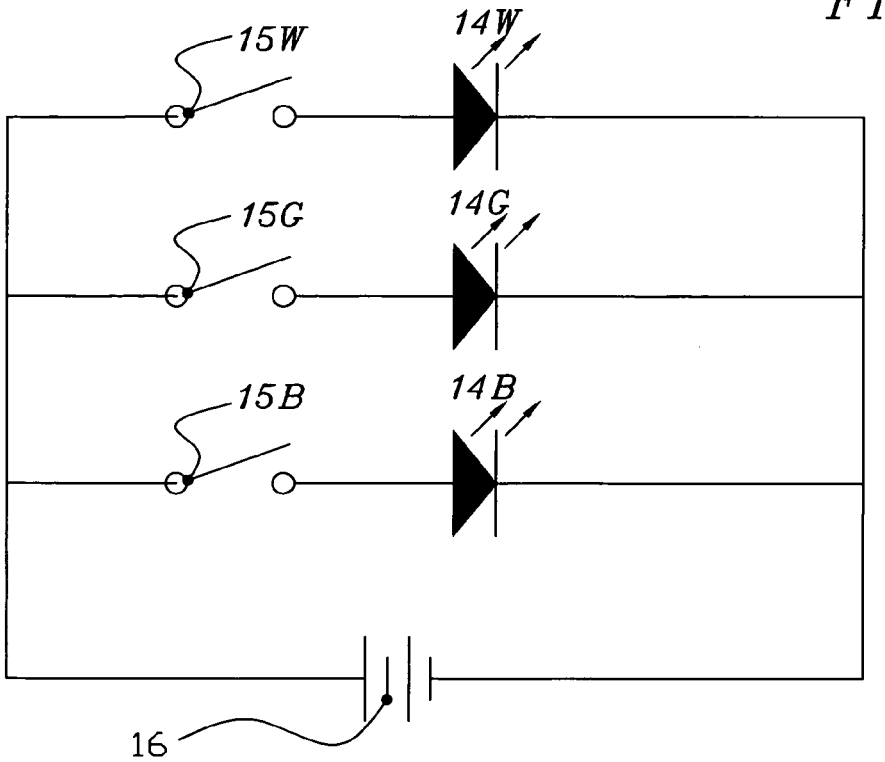
FIG. 5 is an electrical schematic of the circuit of the lighting device of FIG. 1

FIG. 5 is an electrical schematic of circuit 13. Circuit 13 is fabricated using conventional circuit traces—not shown—on PC board 17. Each of the components of circuit 13 are surface mount components although other mounting systems can easily be employed. Surface mount LED lamps are close to PC board 17 and therefore can dissipate their heat more effectively than thru hole designs. Thus surface mount LED lamps can be more efficient in the present design. Looking at the electrical schematic of FIG. 5 it can be seen that closing white switch 15W will energize white LED 14W with power supply 16. Similarly closing green switch 15G will energize green LED 14G and closing blue switch 15B will energize blue LED 14B. Each of the switches are surface mounted momentary "ON" push button switches. FIG. 4 shows PC board 17 as circular. White LED 14W has white LED element 14WE, green LED 14G has green LED element 14GE and blue LED 14B has blue LED element 14BE. Therefore lighting device 25 comprises three distinct colors however, any plurality of colors can be used. Each LED element is placed on LED radius RL and at an angular separation of 120 degrees on LED circle LC centered at element centerline CE located at the center of PC board 17. Each LED element has its related switch placed on PC board 17 aligned with the radius of its related LED element formed on LED circle LC but positioned on larger switch circle SC. It is beneficial for LED circle LC to be larger than switch circle SC because this arrangement usually reduces the overall size of lighting device 25. This results because the switches can be located below parabolic reflector 3 without enlarging lighting device 25. In addition the large size of parabolic reflector 3 relative to switch activator 18 makes positioning reflective centerline CL as close as possible to color changer centerline CR an important objective towards reducing the size of lighting device 25. The center of switch circle SC, the center of LED circle LC, element centerline CE and housing centerline CH are all coincident. Looking at FIG. 3 parabolic reflector 3 has focal point F which is the primary light concentrating point C however there are numerous other light concentrating points near focal point F which will concentrate the light to create a multiplicity of light beams. An alternate light concentrating point is acceptable if the resulting beam is in conformance with a user's requirements. FIG. 3 shows switch activator 18 as a part of color changer 1 and in this embodiment molded as an integral elongated member of cover 6 a transparent plastic cover of color changer 1. Parabolic reflector 3 is attached to cover 6 with an adhesive and cover 6 is attached to shell 4 with an adhesive. Switch activator 18 is a cylindrical pin having switch activator centerline CA and a rounded tip permitting it to depress switches without damaging them.

Figure 6:
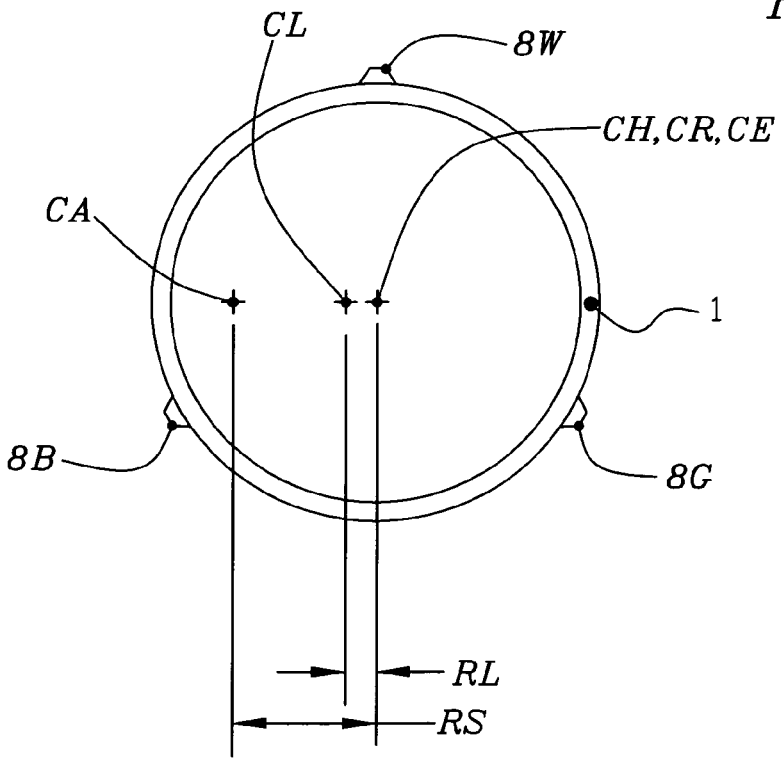
FIG. 6 is a top view of FIG. 3 with some invisible centerlines shown

FIG. 6 is a top view of FIG. 3. In FIG. 6 housing centerline CH, color changer centerline CR and element centerline CE are coincident and shown in FIG. 6 for diagrammatic reasons even though they are not normally visible in that view. Reflector centerline CL is at distance LED radius RL from housing centerline CH. Looking now at FIGS. 1, 3, 4 and 6 but primarily FIG. 4 as color changer 1 is rotated about housing 2 reflector centerline CL moves along a circular reflector centerline locus CLL which is coincident with LED circle LC. Thus as color changer 1 is rotated about housing 2 each LED element is disposed at a light concentrating position relative to parabolic reflector 3 at light concentrating point C where light it emits is concentrated towards parallelism with parabolic reflector centerline CL by parabolic reflector 3. Simultaneously and in a similar fashion as color changer 1 is rotated about housing 2 switch activator centerline CA moves along circular switch activator locus CAL which is coincident with switch circle SC. Thus as color changer 1 is rotated about housing 2 switch activator 18 is disposed at a switch activation position relative to each switch where it depresses the switch to connect power supply 16 to its related LED.

In FIGS. 1, 3 and 6 color changer 1 has been rotated about housing 2 such that arrow 7 aligns with white indicator 8W. This is the color changer indexing position for white LED element 14WE. At this white LED element 14WE indexing position of color changer 1 as seen in FIG. 1 white LED element 14WE is disposed at white LED element 14WE light concentrating position relative to parabolic reflector 3 at focal point F of parabolic reflector 3 to concentrate light emitted from white LED element 14WE towards parallelism with parabolic reflector 3 centerline CL.

At white LED 14W indexing position of color changer 1 white switch 15W is disposed at white switch activation position relative to color changer 1 with switch activator 18 depressing white switch 15W to connect and energize white LED element 14WE with power supply 16. This is the switch activation position of white switch 15W for white LED element 14WE where white switch 15W is effecting the connection of white LED element 14WE to power supply 16 thereby energizing white LED element 14WE to emit a distinct colored light. This system could also be described as color changer 1 effecting the connection of white LED element 14WE to power supply 16. The light emitted by white LED element 14WE is efficiently concentrated by parabolic reflector 3 to be brought towards parallelism with reflector centerline CL to emerge from lighting device 25 as a concentrated light beam. White LED element 14WE is shown at focal point F however it can be located at any light concentrating point which results in its emitted light being concentrated according to a user's specification requirement. Some specifications require an enlarged partially concentrated beam spread and for these specifications white LED element 14WE is placed at a light concentrating point located at a small distance from focal point F.

As color changer 1 is rotated an additional 120 degrees arrow 7 becomes aligned with green indicator 8G. For the reasons already discussed at green LED element 14GE indexing position green switch 15G is depressed by switch activator 18 to connect and energize green LED 14G with power supply 16 causing it to emit green light which is concentrated by parabolic reflector 3.

As color changer 1 is rotated further arrow 7 moves away from green indicator 8G and switch activator 18 moves away from green switch 15G deactivating it consequently de-energizing green LED 14G. Additional rotation of color changer 1 aligns arrow 7 with blue indicator 8B. For reasons already discussed at blue LED element 14BE indexing position blue switch 15B is depressed by switch activator 18 and closes circuit 13 to connect blue LED 14B to power supply 16 causing blue LED element 14BE to be energized and emit blue light which is efficiently concentrated by parabolic reflector 3. Looking at FIG. 1 if color changer 1 is rotated and positioned with arrow 7 aligned with "OFF" indicator 9 none of the switches are at their switch activation position and therefore lighting device 25 is "OFF" or de-energized in an "OFF" mode consuming no energy. Color changer 1 has a plurality of indexing positions comprising an indexing position for each LED element where arrow 7 aligns with the indicator for that LED element, the LED element is at the light concentrating focal point F of parabolic reflector 3 and the switch for the LED element is activated connecting and energizing the LED element with power supply 16. Color changer 1 is rotated to a selected indexing position related to one LED element to selectively emit from lighting device 25 the distinct colored light related to that LED element from the plurality of colors available at different indexing positions and to position parabolic reflector 3 to reflect and bring towards parallelism the emitted light.

FIG. 7 is an enlarged diagrammatic view of parabolic reflector 3 and white LED 14W removed from FIG. 3. FIG. 8 is a diagrammatic perspective view of a typical LED similar to white LED 14W and FIG. 9 is a cross-section taken across 9-9' of FIG. 8. FIGS. 8 and 9 show the construction of a typical commercially available ceramic body surface mount LED having no lens. White LED 14W of FIGS. 8 and 9 includes white LED element 14WE which emits white light supported by white LED base 14C. White LED base 14C comprises a flat top base. Avoiding projections such as lenses on the LED base reduces the possibility that moving parabolic reflector 3 will interfere with a projection and damage white LED 14W. Other features such as the electrical contact pads on the bottom of white LED base 14C are not shown. White LED element 14WE emits light into the hemisphere comprising forward light rays R and oblique rays RO. Parabolic reflector 3 reflects those light rays that it intersects and brings them towards parallelism with reflector centerline CL into a light beam which passes through cover 6 and emerges from lighting device 25 as projected light P. Parabolic reflectors like parabolic reflector 3 are designed to maximize the percentage of emitted light which is being reflected. In prior art designs the LED element is normally positioned within the reflector so that all of its emitted light is reflected into a concentrated light beam. In other prior art designs where the LED element cannot be positioned within the reflector clearance distance D measured between reflector base line B of parabolic reflector 3 and focal point F as shown in FIG. 7 is minimized towards zero. This is done so that all emitted light rays which can be reflected by parabolic reflector 3 are intersected and concentrated by parabolic reflector 3 with the limitation in reducing clearance distance D to zero being that with clearance distance D at zero component size variations will cause parts to interfere and damage each other as the lighting device is assembled. In prior art clearance distance D is minimized with focal point F as close to reflector base line B as possible so that parabolic reflector 3 maximizes the quantity of light emitted from white LED element 14 WE which is reflected.

Looking at FIGS. 7, 8 and 9 we see that in the present invention with white LED element 14WE at its light concentrating position and coincident with focal point F of parabolic reflector 3 there is clearance distance D between parabolic reflector 3 and white LED 14W. This clearance distance is not desirable because oblique light rays RO emitted from white LED element 14WE at oblique angles from white LED axis 14WA are not intersected by parabolic reflector 3 and are lost. White LED axis 14WA is the geometrical axis of the light emitted from white LED 14W which comprises forward light rays R plus oblique light rays RO. In FIG. 9 white LED axis 14W passes through the center of white LED base 14WC. Parabolic reflector 3 which has a lateral movement relative to white LED element 14WE is moved by color changer 1 so that reflector centerline CL remains substantially parallel to white LED axis 14WA. This is defined as lateral movement. Parabolic reflector 3 has a lateral movement relative to each of the LED elements in lighting device 25.

In the present invention clearance distance D is increased over prior art because parabolic reflector 3 is rotated relative to each LED including white LED 14W of FIG. 7. If clearance distance D is not large enough to maintain a clearance during rotation of color changer 1 parabolic reflector 3 will catch on white LED 14W and damage the circuit. Clearance distance D must be predetermined as large enough between white LED element 14WE and reflector base line B to avoid damage to all of the LEDs in the circuit taking into account the movement and flexing necessary to accommodate the rotating relationship that exists between color changer 1 and housing 2. Therefore in the present embodiment parabolic reflector 3 is contoured to establish focal point F or light concentration point C exterior to parabolic reflector 3 at clearance distance D away from reflector base line B.

The preferred embodiment of the present invention as shown in FIGS. 1 through 9 employs discrete LED light sources including white LED 14W, green LED 14G and blue LED 14B which are all flat top designs having no integral lenses.

FIG. 10 is top view of plural color LED 24 which includes plural white element 24WE, plural green element 24GE and plural blue element 24BE each positioned on plural LED base 24C at a radial distance equal to LED radius RL from plural LED center PC and at an angular separation of 120 degrees. Plural LED base 24C is physically similar to white LED base 14WC in that both are rectangular in shape.

Looking back at FIG. 4 where the three LED lights are at radial distance LED radius RL from element centerline CE and at an angular separation of 120 degrees it can be seen that single plural color LED 24 can be substituted for white LED 14W, blue LED 14B and green LED 14G if plural LED center PC is disposed coincident with housing centerline CH on printed circuit board 17. Therefore with proper placement of single plural color LED 24 lighting device 25 will function to emit any of three colors upon proper color selection by indicator arrow 7. Using a single plural color LED 24 in place of three discrete LEDs offers several advantages. The single plural color LED 24 can be manufactured with the LED radius RL greatly reduced. This beneficially reduces the size of lighting device 25. Also plural color LED 24 comprises all of its LED elements on single flat top plural LED base 24C avoiding the variations in height and locations relating to three separate LEDs which can cause interference with color changer 1 as it moves.

Although the description above contains many specificities, these should not be construed as limiting the scope of the invention but as merely providing illustrations of some of the presently preferred embodiments of this invention. For example preferred embodiment power supply 16 is a lithium 3 volt PC mount coin cell battery. However the present invention can function well with other battery types positioned within housing 2 in a fashion similar to a flashlight. Also power supply 16 need not be a battery. It can be a capacitor or an external power supply. Also in the preferred embodiment switches 15W, 15G and 15B are surface mount momentary "ON" switches activated by switch activator 18 an integral part of cover 6. However one skilled in the art can employ other switch types and other switch activator designs to employ the concepts of the present invention. Hall effect switches activated by a magnet can also be employed in the present invention.

Also in the preferred embodiment of the present invention color changer 1 is rotated to an indexing position for each of the plurality of LED emitters where arrow 7 aligns with an indicator for the related LED emitter. This rotation also moves parabolic reflector 3 such that each LED emitter is positioned at its light concentrating position. Arrow 7 is part of a visual indicator system, however since each LED emitter is illuminated as its switch is activated by color changer 1 as it is moved to its indexing position it is possible to use the illumination of the LED emitter as the visual indicator and not require indicator arrow 7 or indicators 8W, 8G or 8B. Using the illumination of each LED element to locate the indexing position of color changer 1 related to that LED element would reduce the complexity and cost of the current invention but it would not reveal the color of light to be emitted until it was already being emitted. Alternatively a variety of common spring loaded catch designs can also be used as non-visual indicators to locate the indexing positions to employ the concepts of the present invention.

Finally the preferred embodiment employs a rotating movement of color changer 1 comprising an equal angular magnitude of movement between indexing positions. Other movements can also be used to employ the concepts of the present invention.

Thus the scope of the invention should be determined by the appended claims and their legal equivalents rather than by the examples given.

I claim:

1. A plural lighting device comprising:

a housing comprising a circuit including a plurality of switches and a plurality of LED emitters, said plurality of LED emitters having a plurality of colors of light, each of said plurality of LED emitters having a related switch and upon being connected to a power supply emitting one of said plurality of colors of light;

a color changer moveably attached to said housing, said color changer comprising a switch activator and a light concentrating reflector for concentrating and projecting from said lighting device light emitted from a light concentrating point of said reflector; and each of said plurality of LED emitters having an indexing position of said color changer relative to said housing for selective disposition at said light concentration point and connection to said power supply by selective disposition of said switch activator about the related switch whereby said color changer is operable to select concentration and projection of a selected color of light from said plurality of colors of light.

2. A plural color lighting device according to claim 1 which further includes;

each of said plurality of LED emitters having said related switch comprising a push button switch.

3. A plural color lighting device according to claim 1 which further includes;

said switch activator comprising an elongated member, wherein the elongated member protrudes from an inner surface of said color changer.

4. A plural color lighting device according to claim 1 which further includes;

said power supply comprising a battery contained within said plural color lighting device.

5. A plural color lighting device according to claim 1 wherein;

said plurality of LED emitters are components of a single plural color LED.

6. A plural color lighting device according to claim 1 which further includes;

a clearance distance between each of said plurality of LED emitters and a base line of said reflector for unencumbered lateral movement between each of said plurality of LED elements and said reflector.

7. A plural color lighting device according to claim 1 wherein;

said reflector is parabolic.

8. A plural color lighting device according to claim 1 which further includes;

a flat top base for at least one of said plurality of LED emitters.

9. A plural color lighting device according to claim 1 which further includes;

each of said plurality of LED emitters positioned on an LED circle with said related switch positioned on a switch circle; and said switch circle larger than said LED circle.

10. A plural color lighting device according to claim 1 which further includes;

each of said plurality of LED emitters having an indicator on said color changer for alignment with a housing indicator to indicate the indexing position.

11. A plural color lighting device according to claim 1 which further includes;

said color changer having an "OFF" indexing position for de-energizing said lighting device.

12. A plural color lighting device comprising;

a housing comprising a circuit including a plurality of LED emitters having a plurality of colors of light;

a color changer moveably attached to said housing, said color changer comprising a light concentrating reflector; and each of said plurality of LED emitters having an indexing position of said color changer for selective disposition about said light concentrating reflector for upon connection to a power supply concentrating one of said plurality of colors.

13. A plural color lighting device according to claim 12 which further includes;

said color changer having a switch activator, each of said plurality of LED emitters having a related switch on said housing for effecting connection to said power supply and disposed for activation by a switch activator concurrent with the selective disposition of said light concentrating reflector about the LED emitter.

14. A plural color lighting device according to claim 13 which further includes;

each of said plurality of LED emitters positioned on an LED circle with said related switch positioned on a switch circle; and said switch circle larger than said LED circle.

15. A plural color lighting device according to claim 12 which further includes;

said power supply comprising a battery contained within said plural color lighting device.

16. A plural color lighting device according to claim 12 wherein;

said plurality of LED emitters are components of a single plural color LED.

17. A plural color lighting device according to claim 12 which further includes;

a clearance distance between each of said plurality of LED emitters and a base line of said reflector for unencumbered relative lateral movement between each of said plurality of LED elements and said reflector.

18. A plural color lighting device according to claim 12 wherein;

said reflector comprises a light concentration point exterior to said reflector.

19. A plural color lighting device according to claim 12 which further includes;

a flat top base for at least one of the LED emitters.

20. A plural color lighting device comprising;

a color changer moveably attached to a housing, said color changer including a switch activator and a light concentrating reflector;

a plurality of LED emitters having a plurality of colors of light and attached to said housing, each of the LED emitters having a related switch on said housing and emitting a distinct colored light upon being connected to a power supply; and said color changer moveable to an indexing position for each of the LED emitters concurrently positioning said light concentrating reflector about the LED emitter and disposing—said switch activator about the related switch effecting a connection to said power supply, whereby said color changer can be moved to select the distinct colored light to be concentrated by said reflector.

21. A plural color lighting device according to claim 20 which further includes;

each of said plurality of LED emitters having said related switch comprising a push button switch.

22. A plural color lighting device according to claim 20 which further includes;

said switch activator comprising an elongated member, wherein the elongated member protrudes from an inner surface of said color changer.

23. A plural color lighting device according to claim 20 which further includes;

said power supply comprising a battery contained within said plural color lighting device.

24. A plural color lighting device according to claim 20 wherein;

said plurality of LED emitters are components of a single plural color LED.

25. A plural color lighting device according to claim 20 which further includes;

said reflector is parabolic.

26. A plural color lighting device according to claim 20 which further includes;

a flat top base for at least one of the LED emitters.

27. A plural color lighting device according to claim 20 which further includes;

said color changer having a rotational movement relative to said housing.

28. A plural color lighting device according to claim 20 which further includes;

each of said plurality of LED emitters positioned on an LED circle with said related switch positioned on a switch circle; and said switch circle larger than said LED circle.

29. A plural color lighting device according to claim 20 which further includes;

said color changer having an "OFF" indexing position relative to said housing whereby said color changer can be moved to turn all of the LED emitters "OFF".

30. A plural color lighting device comprising;

a plurality of LED emitters attached to a housing and having a plurality of colors of light;

each of said plurality of LED emitters emitting a distinct colored light upon being connected to a power supply and each upon being positioned at a light concentrating point of a light concentrating reflector having said distinct colored light concentrated and projected from said lighting device; and a color changer means for selectively disposing each of said plurality of LED emitters at said light concentrating point and effecting connection to said power supply whereby said color changer means operates to select from said plurality of colors of light the distinct colored light concentrated by said light concentrating reflector.

31. A plural color lighting device comprising:

a plurality of LED emitters having a plurality of colors attached to a housing, each of said plurality of LED emitters upon being energized by a power supply emitting a distinct colored light and upon being positioned at a light concentrating point of a reflector having said distinct colored light concentrated and projected from said lighting device; and a color changer moveably connected to said housing and comprising said reflector, said reflector having a substantially lateral movement relative to said plurality of LED emitters for selectively positioning said light concentrating point at each of said plurality of LED emitters, said color changer operable to effect concentration of the distinct colored light of a selected LED emitter of said plurality of LED emitters upon the selected LED emitter being energized by said power supply.

32. A plural color lighting device comprising:

a housing comprising a circuit, said circuit including a plurality of LED emitters having a plurality of colors of light and a plurality of switches;

a color changer comprising a switch activator and a reflector for concentrating light towards parallelism, said color changer moveably attached to said housing and having a plurality of positions; and each of said plurality of LED emitters upon being connected to a power supply emitting a distinct colored light, each having a light concentrating position relative to said reflector for said distinct colored light being concentrated by said reflector, each having a related switch and a related switch activation position for said switch activator activating the related switch for connection to said power supply, each having an indexing position of said color changer relative to said housing, each upon said color changer being positioned at said indexing position disposed at said light concentrating position and disposed at said switch activation position for emitting the distinct colored light concentrated by said reflector towards parallelism whereby said color changer is operable to select the distinct colored light emitted and concentrated by said lighting device.

33. A plural color lighting device comprising:

a color changer moveably attached to a housing, said color changer having a light concentrating reflector, said housing having a circuit including a first LED emitter for emitting a first color light and a second LED emitter for emitting light a second color light, said color changer having a first indexing position for effecting disposition of said light concentrating reflector about said first LED emitter concentrating said first color light upon said first color light being emitted from said first LED emitter; and said color changer having a second indexing position for effecting disposition of said light concentrating reflector about said second LED emitter concentrating said second color light upon said second color light being emitted from said second LED emitter whereby said color changer can be used to change the color of light to be concentrated by said light concentrating reflector from said first color light to said second color light.

34. A plural color lighting device of claim 33 wherein;

said first LED emitter and said second LED emitter are components of a single plural color LED.

35. A plural color lighting device of claim 33 wherein;

said color changer has an inner surface exposed to a switch; and a switch activator protruding from said inner surface, whereby the rotation of said color changer from said first indexing position to said second indexing position effects contact between said switch activator and said switch energizing said second LED emitter with a power supply effecting emission of said second color light.

36. A plural color lighting device of claim 33 wherein;

said light concentrating reflector includes a base line disposed at a distance from said housing, at a clearance distance from said first LED emitter and at a clearance distance from said second LED emitter whereby movement of said color changer and said light concentrating reflector is made without contacting said first LED emitter or said second LED emitter.

37. A plural color lighting device comprising:

a color changer moveably attached to a housing, said color changer having a light concentrating reflector, said housing having a circuit including a first LED emitter for emitting a first color light and a second LED emitter for emitting light a second color light, said color changer having a first indexing position for effecting disposition of said light concentrating reflector about said first LED emitter concentrating said first color light upon said first color light being emitted from said first LED emitter;

said color changer having a second indexing position for effecting disposition of said light concentrating reflector about said second LED emitter concentrating said second color light upon said second color light being emitted from said second LED emitter whereby said color changer can be used to change the color of light to be concentrated by said light concentrating reflector from said first color light to said second color light;

said color changer has an inner surface exposed to a switch; and a switch activator protruding from said inner surface, whereby the rotation of said color changer from said first indexing position to said second indexing position effects contact between said switch activator and said switch energizing said second LED emitter with a power supply effecting emission of said second color light.

38. A plural color lighting device comprising:

a color changer moveably attached to a housing, said color changer having a light concentrating reflector, said housing having a circuit including a first LED emitter for emitting a first color light and a second LED emitter for emitting light a second color light, said color changer having a first indexing position for effecting disposition of said light concentrating reflector about said first LED emitter concentrating said first color light upon said first color light being emitted from said first LED emitter;

said color changer having a second indexing position for effecting disposition of said light concentrating reflector about said second LED emitter concentrating said second color light upon said second color light being emitted from said second LED emitter whereby said color changer can be used to change the color of light to be concentrated by said light concentrating reflector from said first color light to said second color light; and said light concentrating reflector includes a base line disposed at a distance from said housing, at a clearance distance from said first LED emitter and at a clearance distance from said second LED emitter whereby movement of said color changer and said light concentrating reflector is made without contacting said first LED emitter or said second LED emitter.

* * * * *